United States Patent [19]

Tauchi

[11] Patent Number: 4,724,932

[45] Date of Patent: Feb. 16, 1988

[54] MONITORING APPARATUS FOR ELEVATOR

[75] Inventor: Nobuji Tauchi, Inazawa, Japan

[73] Assignee: Mitsubishi Denki Kabushiki Kaisha, Japan

[21] Appl. No.: 11,755

[22] Filed: Feb. 6, 1987

[30] Foreign Application Priority Data

Feb. 12, 1986 [JP] Japan ..... 61-28443

[51] Int. Cl.[4] ..... B66B 3/02

[52] U.S. Cl. ..... 187/136

[58] Field of Search ..... 187/134, 136, 135, 137

[56] References Cited

U.S. PATENT DOCUMENTS 4,102,437 7/1978 Mandel ..... 187/136

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

A monitoring apparatus for an elevator in which the cage floor positions are usually displayed roughly in analog form, and are displayed in digital form at the time of a disaster or at the time of selection, thereby to present a cage floor position display which is easy to see and which adapts to the different situations. The elevator monitoring apparatus comprises cage position display selection means for changing the manner in which the cage's floor position is being displayed from an analog cage position display form, which indicates the cage's floor position as a rough floor position within a building, to a digital cage position display form, whereby the exact floor position during a disaster condition such as a breakdown is displayed, in response to the activation of a selection switch.

5 Claims, 5 Drawing Figures

MONITORING APPARATUS FOR ELEVATOR

BACKGROUND OF THE INVENTION

This invention relates to a monitoring apparatus for an elevator in which the positions of the cages of the elevator are usually displayed as rough positions within a building in analog fashion, whereas they are displayed in digital fashion during a disaster or during the turn-on of a selection switch.

Heretofore, indication with lamps has been commonly employed in a monitoring panel for an elevator. In such a case, when the elevator breaks down, a caretaker is informed of the breakdown by a buzzer or the like. The caretaker checks the states of the lamps and notes the position of the abnormality, whereupon he/she takes a necessary steps.

In recent years, a CRT (cathode-ray tube) has come into use for indication in a supervision panel. An example thereof is disclosed in the official gazette of Japanese Patent Application Laid-open No. 58-78978.

The indication on the CRT in this case displays the elevator system as shown in FIG. 5. Numeral 1 designates a cage frame display, numeral 2 a cage floor position, numeral 3 a running direction, and numeral 4 cage number denoted respectively in each of the cage frame displays 1. FIG. 5 illustrates a case where eight cages, cages No. 1–No. 8 are displayed. Ordinarily, the cage floor positions are displayed in digital fashion as indicated by 2 in FIG. 5.

The prior-art monitoring apparatus for the elevator is constructed and operated as described above. Therefore, it has the problems in that the display disturbs the eye in a case where the cage floor positions change frequently and that the positional relationship of the floors within a building is difficult to understand at a mere glance.

SUMMARY OF THE INVENTION

This invention has been made in order to eliminate such problems, and has for its object to provide a monitoring apparatus for an elevator in which the cage floor positions of the elevator are usually roughly displayed in analog form and are displayed in digital form during a disaster or during manual selection, thereby providing a cage floor position display easy to see in adaptation to a monitoring situation.

The monitoring apparatus for an elevator according to this invention comprises cage position display selection means capable of analog cage position display for indicating cage floor positions as rough floor positions within a building, and a digital cage position display for indicating the exact floor positions during a disaster such as a breakdown, or by the turn-on of a selection switch.

In this invention, the analog cage position display of the cage position display selection means indicates the rough floor positions of the cages of the elevator system within the building, thereby providing an intuitive understanding of the cage positions, while the digital cage position display indicates the exact positions of the cages at the time of a disaster etc., thereby to compensate for the approximate information provided by the monitoring function with only the rough floor positions.

BRIEF DESCRIPTION OF THE DRAWINGS

Throughout the drawings, the same symbols denote identical or corresponding portions.

DESCRIPTION OF THE PREFERRED EMBODIMENT

Figure 1:
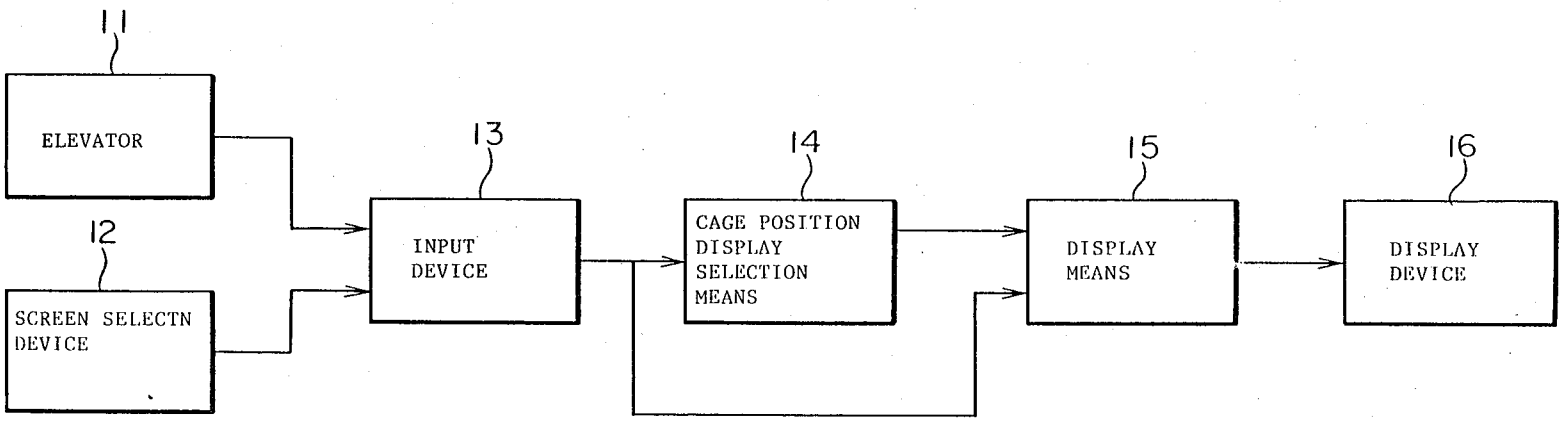
FIG. 1 is a block diagram showing the whole arrangement of an embodiment of a monitoring apparatus for an elevator according to this invention.

Now, an embodiment of a monitoring apparatus for an elevator according to this invention will be described with reference to the drawings. FIG. 1 is a block diagram for showing the principle of the embodiment of this invention. In the figure, numeral 11 designates an elevator, and numeral 13 an input device. This input device 13 accepts a status signal fed from the elevator 11, and a switch signal fed from a screen selection device 12 which is furnished with a switch for selecting a screen.

Cage position display selection means 14 receives a signal indicative of a disaster state such as a breakdown condition and the switch signal of the screen selection device 12 as are supplied from the input device 13, and decides on a display form.

Display means 15 receives information representative of the cage position supplied from the input device 13, and commands a display device 16 to display the cage position in accordance with a signal from the cage position display selection means 14.

Figure 2:
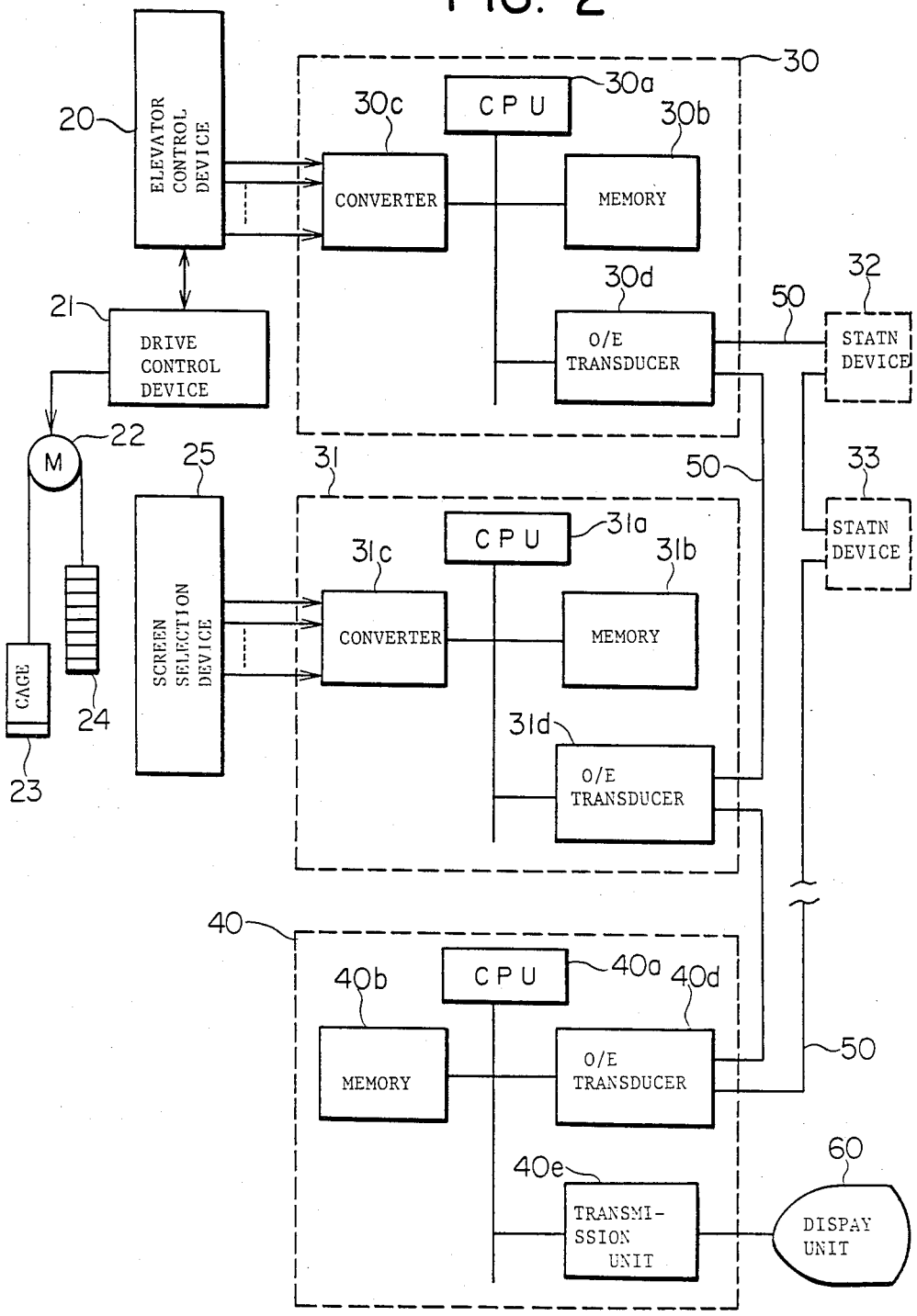
FIG. 2 is a circuit diagram showing a practicable example of the elevator monitoring apparatus in FIG. 1.

FIG. 2 shows a practicable example for realizing the fundamental arrangement illustrated in FIG. 1. In the figure, numeral 20 designates an elevator control device, the details of which are not shown. An elevator drive control circuit 21 is connected to the elevator control device 20 so as to transfer signals therebetween. In addition, the drive control circuit 21 delivers a drive signal to a hoist motor 22 in the elevator system to control this hoist motor 22, thereby controlling a cage 23 and a counterweight 24 to ascend and descend.

Numeral 30 designates an optical transmission slave station device, which receives the status signal of the elevator from the elevator control device 20 and which converts this status signal into an optical signal and then delivers the latter to an optical cable 50. The slave station device 30 is constructed of a cpu (central processing unit) **30*a*, a memory 30*b* which stores a program for the optical conversion processing, the processed results of the CPU 30*a*, etc., a converter 30*c* by which status signals including cage position information from the elevator control device 20 are converted into signals suitable for internal digital processing, and an optoelectric (hereinbelow, abbreviated as "O/E") transducer 30*d* which is interposed between the CPU 30*a* and the optical cable 50** and which changes an optical signal into an electric signal or vice versa.

Further, an optical transmission slave station device 31 receives a screen selection signal from a screen selection device 25 and has the same structure as that of the optical transmission slave station device 30. The constituents of the optical transmission slave station device 31 are respectively denoted by numerals 31 to which the alphabetic suffixes "a"–"d" of the corresponding constituents of the optical transmission slave station 30 are attached.

Shown at numerals 32 and 33 are optical transmission slave station devices each of which is connected to the optical cable 50 and correspond to another cage of the elevator system.

Numeral 40 designates an optical transmission master station device which receives signals sent from the optical transmission slave station devices 30, 31, 32 and 33. The master station device 40 comprises a CPU 40*a*, a memory 40*b* and an O/E transducer 40*d* similar to the optical transmission slave station device 30. Further, it has a transmission slave station device 30. Further, it has a transmission unit 40*e* for controlling a display unit 60 (shown as a CRT in the figure, and corresponding to the display device 16 in FIG. 1), which displays the status of the elevator system.

Figure 4:
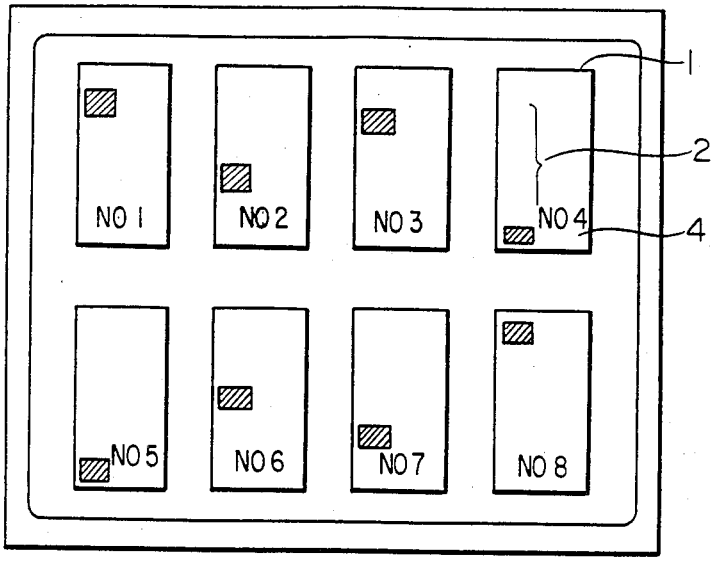
FIG. 4 is a diagram showing a cage position floor display presented on an elevator display unit in a prior art.
Figure 5:
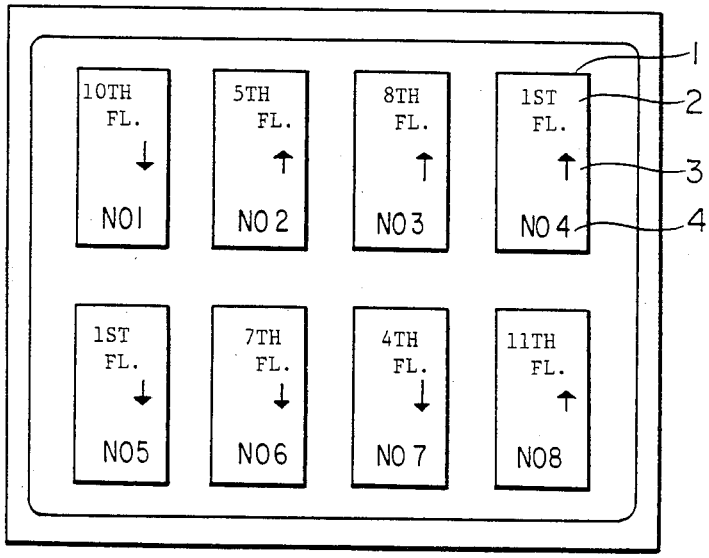
FIG. 5 is a diagram showing a cage position floor display presented on an elevator display unit according to this invention.

As shown in FIG. 4, the display unit 60 usually displays cage position 2 in analog fashion within cage frame displays 1. Numeral 4 denotes the No. of each cage of the elevator.

Although only the four optical transmission slave station devices are illustrated in FIG. 2, this embodiment is equipped with slave station devices which correspond to eight cages as well as a group-supervisory control device for group-supervising the eight cages and the slave station device which is associated with the screen selection device.

Now, the operation of this embodiment will be outlined before the detailed explanation thereof. The position of the elevator cage 23 is detected by the elevator control device 20 through the drive control circuit 21, whereupon contact signals are delivered to the optical transsmission slave station device 30. The converter 30*c* disposed in the slave station device 30 converts the contact signals into a digital signal, which is stored in the memory 30*b* as cage position data.

The status signals of the other cages are similarly stored in the memories 30*b* of the slave station devices corresponding to the cages. After the arithmetic processing of the cage position data in the CPU 30*a*, an electric signal is applied to the O/E transducer 30*d*, which changes the input signal into an optical signal and delivers the latter to the optical cable 50.

Meanwhile, the optical signal from the optical transmission slave station device 30 (31, 32 or 33) is stored in the memory 40*b* by the CPU 40*a* through the O/E transducer 40*c* of the optical transmission master station device 40. Further, the stored signal is processed by the CPU 40*a*, and the resulting signal is delivered from the transmission unit 40*e* to the display unit 60. Thus, the cage position is indicated on the screen of the display unit, namely, the CRT 60.

The status signals from the optical transmission slave station devices 32, 33, etc., are similarly sent to the optical transmission master station device 40, whereby the cage positions are indicated on the CRT 60.

Here, the transmission between the O/E transducers 30*d* and 40*d* is a serial transmission based on pulse signals.

The input status signals include the cage position signal, a running direction signal, a running start signal and a running end signal in the case of an earthquake, fire or power failure, a fault signal, etc., as the signals from each cage, and a disaster occurrence signal and a reset signal in the case of an earthquake, fire or power failure, a fault signal for the group supervision function, etc., as signals from the group-supervisory control device.

Figure 3:
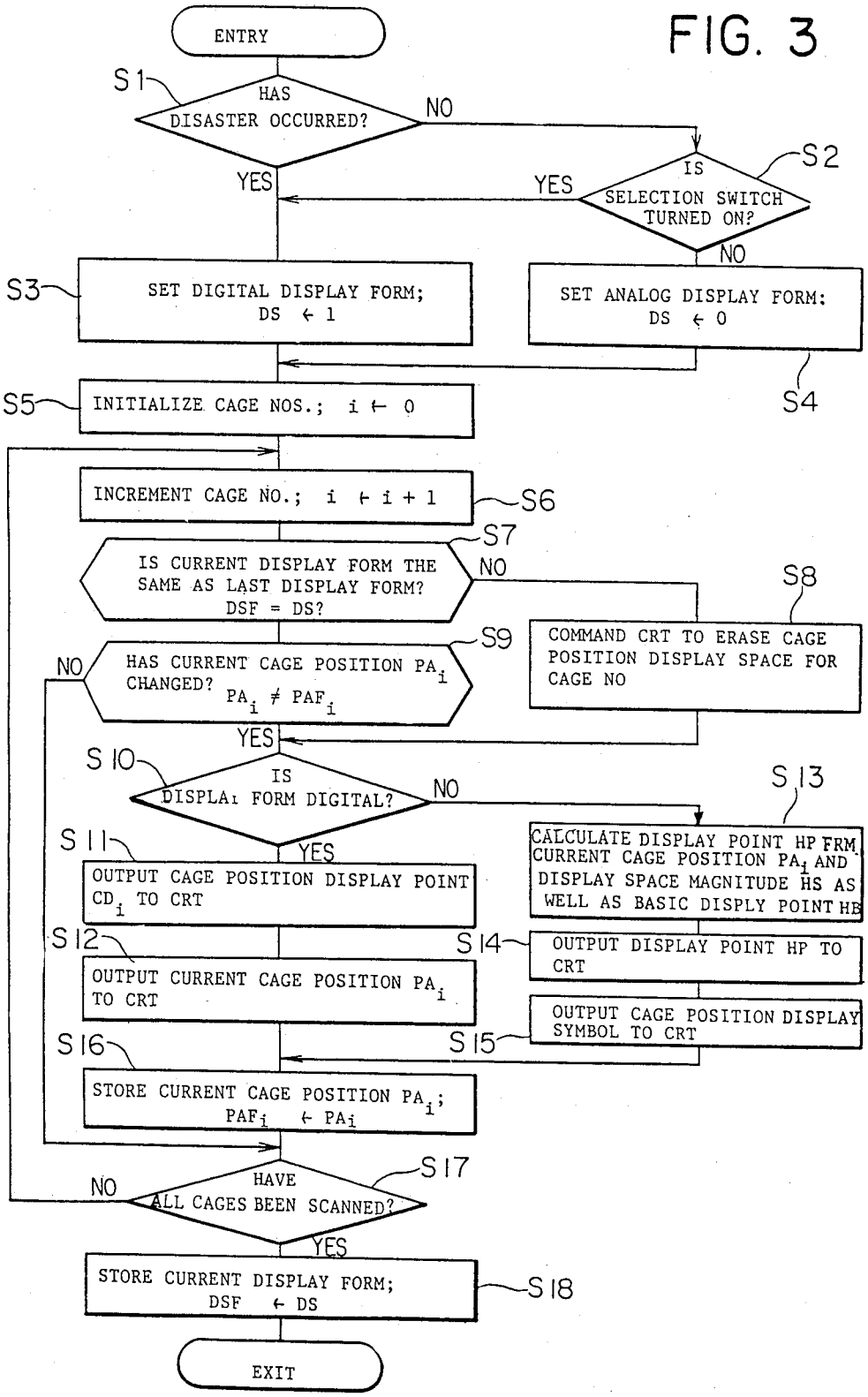
FIG. 3 is a flow chart for explaining the operation of the example in FIG. 2.

FIG. 3 shows a program which is stored in the memory 40*b* in FIG. 2 and represent, the screen selection means 14 in FIG. 1.

In FIG. 3, steps S1–S4 determine a display form (either digital display or analog display). The step S1 determines whether or not a signal representative of a disaster condition, such as a breakdown, is provided from the elevator control device 20, and the step S2 determines whether or not a signal from the screen selection device 12 is ON. According to the result of the step S1 or S2, the display form is set by the step S3 or S4.

A step S5 initializes cage Nos. in order to display the cage position of every cage. A step S6 increments the cage No. A step S7 checks whether or not the display form set by the step S3 or S4 is the same as the form in which the cage positions have already been displayed, and when the forms are different, a step S8 erases a cage position display space.

When the step S7 decides the same display form is to be used, a step S9 checks whether or not the cage position has changed. At a step S10, the form in which the cage position is displayed this time is checked, and subject to the digital form, steps S11 and S12 are performed.

The step S11 delivers a cage position display point $CD_1$ already set, and the step S12 supplies the CRT with the cage position $PA_1$ at this time. On the other hand, when the current display is in the analog display mode at the step S10, steps S13–S15 are performed.

At the step S13, a cage position display point HP is calculated using the cage position $PA_1$ at this time, and a display space magnitude HS and a basic display point HB which are set data items are displayed. Step S14 outputs the display point HP to the CRT, and the step S15 outputs a display symbol therefor.

The cage position is stored at a step S16, the output of all the cage positions is acknowledged at a step S17, and the display form at the current time is stored at a step S18.

As described above, this invention consists in that cage floor positions are usually indicated by displaying the cage position in analog form which roughly indicates the present floor position of the cage within a building, whereas they are indicated by a digital cage position display when a disaster such as a breakdown has occurred or when a selection switch has been turned "on". It therefore becomes possible to display in digital form the exact positions of the cages during a disaster or by the activation of a switch and in analog form the approximate position of the cage during the other times. This brings forth the effect that the cage position being displayed is easy to see in adaptation to the monitoring situation.

What is claimed is:

1. A monitoring apparatus for an elevator which monitors a running status of each cage of a plurality of cages of the elevator, comprising:

an input device for receiving signals indicative of the running status of each cage, a display device for indicating the cage position of each cage, a cage position display selection means responsive to said input device, including means for detecting a running status signal indicative of an emergency situation and generating a command signal in response to detection of an emergency situation;

display means for controlling said display device to indicate the cage position of the plurality of cages simultaneously in an analog form wherein each cage position is indicated by the relative position of a display marking within a cage frame; and said display means including means responsive to said command signal for blanking the analog indication of the position of each cage and replacing it with a digital indication of the position of each cage wherein said digital indication for each cage is displayed within said cage frame display.

2. A monitoring apparatus for an elevator according to claim 1 wherein said input device receives said signals indicative of the running status of said each cage from an elevator control device which is connected to a control circuit for driving said elevator.

3. A monitoring apparatus for an elevator as set forth in claim 1 wherein said display means includes means for causing said display device to simultaneously display a plurality of said frames.

4. A monitoring apparatus for an elevator as set forth in claim 1 wherein said display device is a CRT screen and said display means includes means for simultaneously displaying a plurality of frames in an array format.

5. A monitoring apparatus for an elevator as set forth in claim 3 including a screen selection device responsive to the manual selection of a digital or analog format for said display device for providing a signal to said input device upon selection of a digital format, said input device transferring said signal to said cage position display selection means wherein a means detects said signal and generates said command signal.

* * * * *